US008960862B2

(12) United States Patent
Kitamura et al.

(10) Patent No.: US 8,960,862 B2
(45) Date of Patent: Feb. 24, 2015

(54) INK-JET HEAD AND INK-JET DRAWING DEVICE INCLUDING SAME

(75) Inventors: Ken Kitamura, Outsu (JP); Mitsuyoshi Miyai, Ikoma-gun (JP); Shinya Matsuda, Takarazuka (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/122,879

(22) PCT Filed: Apr. 4, 2012

(86) PCT No.: PCT/JP2012/059187

§ 371 (c)(1),
(2), (4) Date: Nov. 27, 2013

(87) PCT Pub. No.: WO2012/165041

PCT Pub. Date: Dec. 6, 2012

(65) Prior Publication Data

US 2014/0092173 A1 Apr. 3, 2014

(30) Foreign Application Priority Data

May 31, 2011 (JP) ..... 2011-121502

(51) Int. Cl.
*B41J 2/14* (2006.01)
*B41J 2/045* (2006.01)
*B41J 2/055* (2006.01)

(52) U.S. Cl.
CPC ..... *B41J 2/14201* (2013.01); *B41J 2/055* (2013.01); *B41J 2/14233* (2013.01); *B41J 2202/11* (2013.01)
USPC ..... 347/50; 347/68

(58) Field of Classification Search
None
See application file for complete search history.

(56) References Cited

U.S. PATENT DOCUMENTS

| | | | |
|---|---|---|---|
| 2007/0285470 | A1 | 12/2007 | Kanaya |
| 2008/0030548 | A1 | 2/2008 | Kubo |
| 2008/0049077 | A1 | 2/2008 | Sugahara |
| 2011/0226807 | A1 | 9/2011 | Essen et al. |

FOREIGN PATENT DOCUMENTS

| | | |
|---|---|---|
| JP | 61-125854 | 6/1986 |
| JP | 09-51130 | 2/1997 |
| JP | 2002-086713 | 3/2002 |

(Continued)

OTHER PUBLICATIONS

Machine Translation of JP 2005-22192 A, Matsuzawa, 27, Jan. 2005, Paragraphs 0016, 0038, 0055.*

*Primary Examiner* — Lisa M Solomon
(74) *Attorney, Agent, or Firm* — Cozen O'Connor

(57) ABSTRACT

An actuator included in a head substrate of an ink-jet head receives, with an electrode on the surface of the actuator, power fed from the wiring of a wiring substrate arranged opposite the head substrate. A first electrode of the wiring substrate is electrically connected to the wiring, and protrudes to the side of the head substrate. A second electrode is electrically connected to the electrode on the surface of the actuator, protrudes to the side of the wiring substrate and is electrically connected to the first electrode. The head substrate and the wiring substrate are adhered to each other through an adhesive layer such that a space to which the first electrode and the second electrode are exposed is hermetically sealed. The hermetically sealed space is in a vacuum state or is filled with a gas containing a predetermined amount of water or less.

7 Claims, 4 Drawing Sheets

(56) References Cited

FOREIGN PATENT DOCUMENTS

| | | | |
|---|---|---|---|
| JP | 2003-072068 | | 3/2003 |
| JP | 2005-22192 | | 1/2005 |
| JP | 2005022192 | A * | 1/2005 |
| JP | 2007-74892 | | 3/2007 |
| JP | 2007-160752 | | 6/2007 |
| JP | 2007-196544 | | 8/2007 |
| JP | 2007-331137 | | 12/2007 |
| JP | 2008-74091 | | 4/2008 |
| JP | 2009-234087 | | 10/2009 |
| JP | 2011-194889 | | 10/2011 |

* cited by examiner

INK-JET HEAD AND INK-JET DRAWING DEVICE INCLUDING SAME

RELATED APPLICATIONS

This application is a U.S. National Phase Application under 35 USC 371 of International Application PCT/JP2012/059187 filed Apr. 4, 2012.

This application claims the priority of Japanese application No. 2011-121502 filed May 31, 2011, the entire content of which is hereby incorporated by reference.

TECHNICAL FIELD

The present invention relates to an ink-jet head in which a head substrate having an actuator that discharges ink from a pressure chamber and a wiring substrate for feeding power to the actuator are arranged opposite each other and to an ink-jet drawing device which performs drawing with such an ink-jet head.

BACKGROUND ART

Conventionally, an ink-jet drawing device is developed that drives an actuator to discharge ink within a pressure chamber through a nozzle and thereby performs drawing (image formation) on a recording member. In the ink-jet drawing device as described above, in order to realize drawing with more accuracy and higher definition, it is required to further densely arrange the nozzles in the ink jet head. For example, it is possible to realize the highly dense arrangement of the nozzles and perform drawing with higher definition by arranging a plurality of rows of nozzles and displacing the nozzles a half pitch for each row to arrange them.

Here, in a line head in which only one row of nozzles are arranged, a wiring for feeding power to an actuator corresponding to each nozzle can be drawn in a direction perpendicular to the direction in which the nozzles are aligned, in a substrate (head substrate) where the nozzles are arranged. In other words, the wiring can be provided on the side of the head substrate. However, in the ink-jet head in which a plurality of rows of nozzles are arranged to perform drawing with higher definition, the highly dense arrangement of the nozzles requires the wirings for the actuators to be highly densely arranged, with the result that it is difficult to form the wirings on the side of the head substrate.

In this respect, for example, in patent document 1, as shown in FIG. 4, a wiring substrate 201 having a wiring 202 for feeding power to each actuator is arranged opposite a head substrate 101. The wiring 202 is electrically connected to the wiring 206 of an external wiring 205 through a driving circuit 203 and a pad portion 204 provided over the wiring substrate 201. In the wiring substrate 201, a penetration electrode 207 is provided that penetrates the wiring substrate 201 and that is electrically connected to the wiring 202. On the other hand, in the head substrate 101, a lead electrode 102 is provided that draws an electrode (for example, an upper electrode of a piezoelectric member) of the actuator, and a pad portion 103 is also provided that is electrically connected to the lead electrode 102.

In this configuration, the pad portion 103 of the head substrate 101 and the penetration electrode 207 of the wiring substrate 201 are electrically connected to each other, and thus it is possible to feed power from the wiring substrate 201 to the head substrate 101. In other words, in this case, it is possible to drive the actuator without provision of any wiring for feeding power to the actuator on the side of the head substrate 101.

RELATED ART DOCUMENT

Patent Document

Patent document 1: JP-A-2007-331137 (see claim 1, paragraphs [0007] and [0026], FIGS. 2 and 3 and the like)

DISCLOSURE OF THE INVENTION

Problems to be Solved by the Invention

However, in patent document 1, the pad portion 103 for electrically connecting the head substrate 101 and the wiring substrate 201 is exposed to the atmosphere. In this configuration, since the pad portion 103 reacts with water (water vapor) in the atmosphere so as to be degraded, when the actuator is repeatedly driven, a contact failure occurs in a part where the pad portion 103 and the penetration electrode 207 are connected to each other, with the result that the reliability of the electrical connection between the head substrate 101 and the wiring substrate 201 is disadvantageously decreased.

The present invention is made to solve the foregoing problem; an object of the present invention is to provide an ink-jet head in which an electrical part between a head substrate and a wiring substrate is prevented from reacting with water in the atmosphere so as to be degraded, in which thus even the repetition of driving of an actuator does not cause a contact failure in the electrical connection between the head substrate and the wiring substrate and which has sufficient reliability, and to provide an ink-jet drawing device including such an ink-jet head.

Means for Solving the Problem

According to the present invention, there is provided an ink-jet head in which a head substrate is arranged opposite a wiring substrate having a wiring, and the head substrate includes: a pressure chamber that holds an ink; a nozzle that serves as a discharge hole of the ink within the pressure chamber; and an actuator that receives, with an electrode on a surface, power fed from the wiring of the wiring substrate and that discharges the ink within the pressure chamber through the nozzle, where the wiring substrate includes a first electrode that is electrically connected to the wiring and that protrudes to a side of the head substrate, the actuator includes a second electrode that is electrically connected to the electrode, that protrudes to a side of the wiring substrate and that is electrically connected to the first electrode, the head substrate and the wiring substrate are adhered to each other through an adhesive layer such that a space to which the first electrode and the second electrode are exposed is hermetically sealed and the hermetically sealed space is in a vacuum state or is filled with a gas containing a predetermined amount of water or less.

In the configuration described above, the actuator of the head substrate receives, with the electrode, through the first electrode and the second electrode, the power fed from the wiring of the wiring substrate arranged opposite the head substrate, and discharges the ink within the pressure chamber through the nozzle.

Here, the space to which the first electrode and the second electrode are exposed is hermetically sealed by adhering the head substrate and the wiring substrate through the adhesive layer. In the hermetically sealed space, since the predetermined amount of water (water vapor) or less is contained, it is possible to prevent the first electrode, the second electrode and the electrical connection part thereof from being degraded by reaction with the water. Hence, it is possible to reduce the occurrence of a contact failure in the electrical connection by the repetition of driving of the actuator, and thus it is possible to enhance the reliability of the electrical connection between the head substrate and the wiring substrate.

Advantages of the Invention

In the present invention, the space to which the first electrode and the second electrode are exposed is hermetically sealed by adhering the head substrate and the wiring substrate through the adhesive layer, and the hermetically sealed space is in a vacuum state or contains the predetermined amount of water or less. Thus, it is possible to prevent the electrical connection part between the first electrode and the second electrode from being degraded with water, and it is possible to reduce the occurrence of a contact failure in the electrical connection by the repetition of driving of the actuator, with the result that it is possible to enhance the reliability of the electrical connection between the head substrate and the wiring substrate.

BEST MODE FOR CARRYING OUT THE INVENTION

An embodiment of the present invention will be described with reference to accompanying drawings.

(About an Ink-Jet Head)

Figure 1:
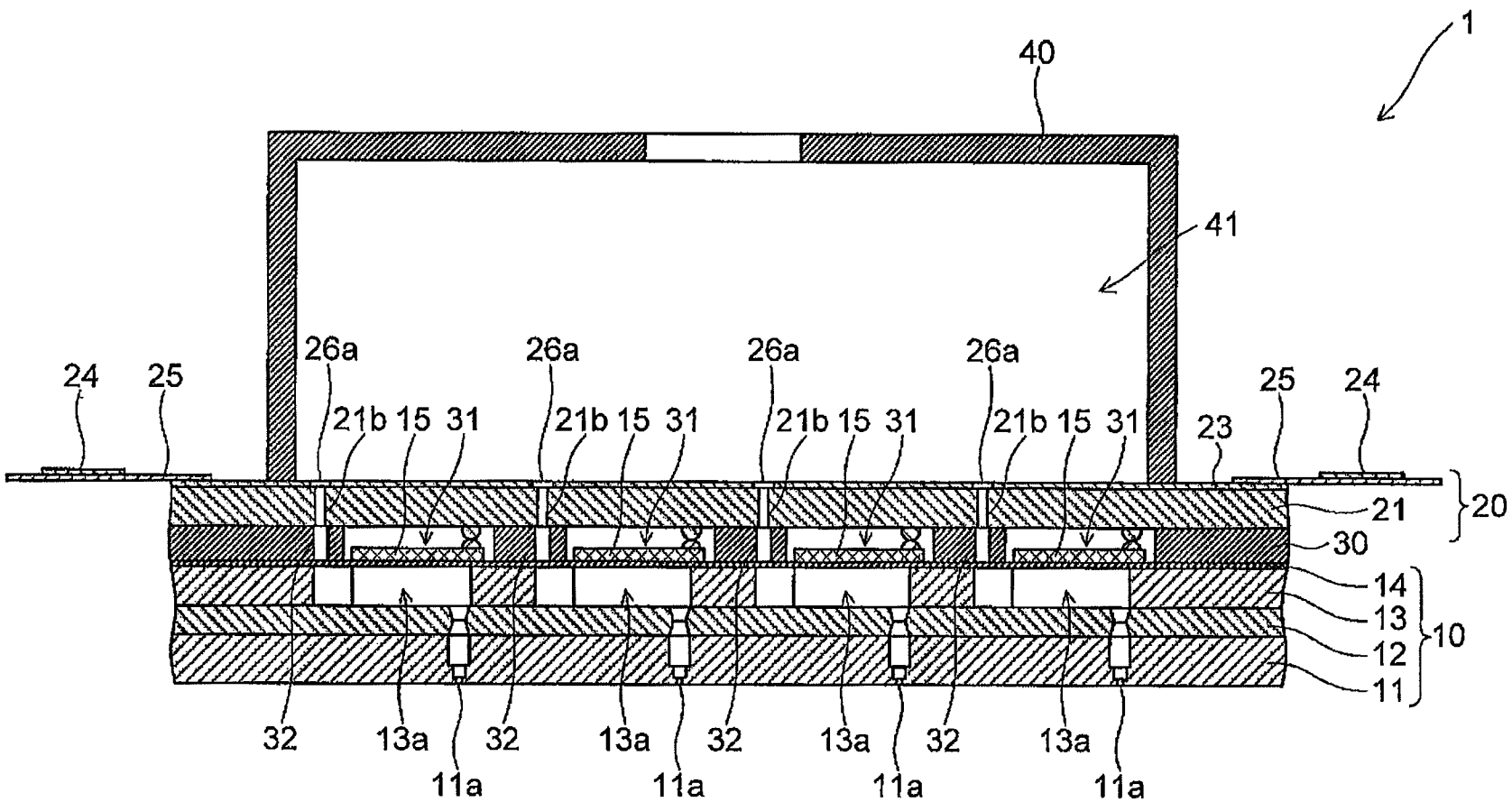
[FIG. 1] A cross-sectional view showing the schematic configuration of an ink-jet head according to an embodiment of the present invention.
Figure 2:
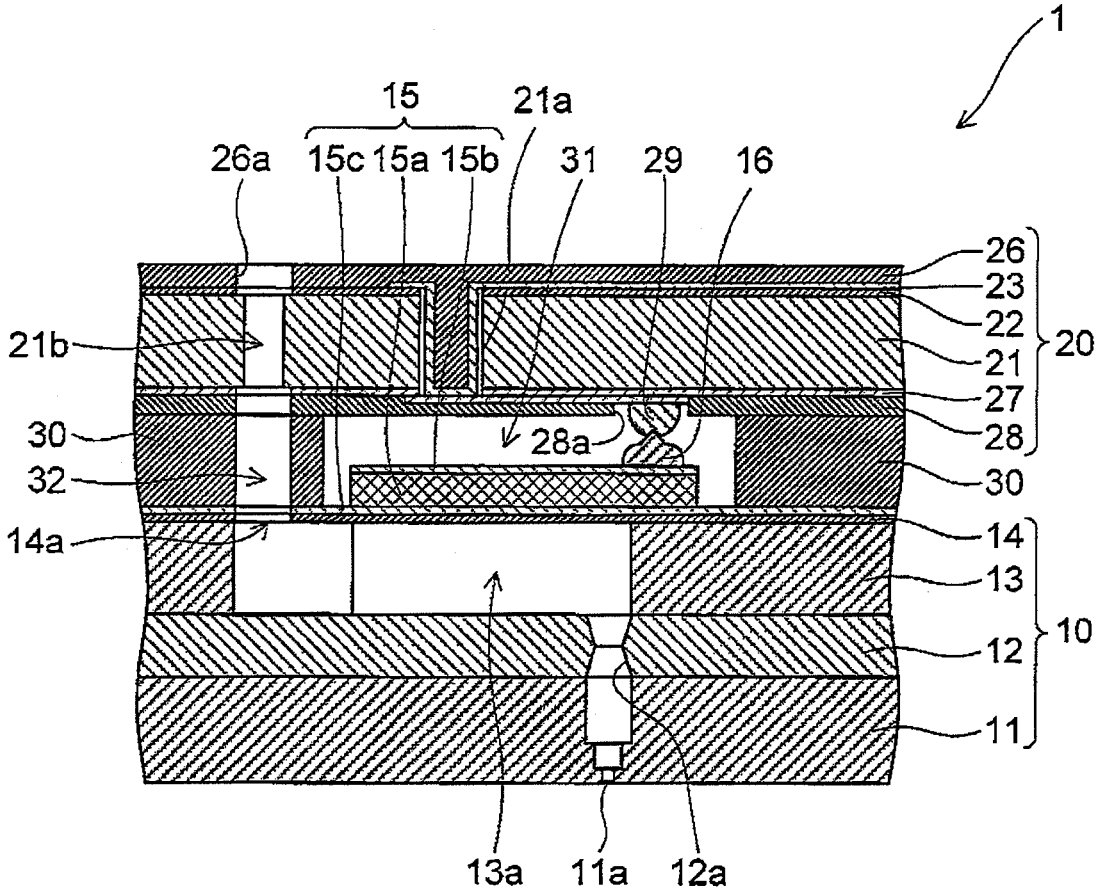
[FIG. 2] A cross-sectional view showing an enlarged main portion of the ink-jet head.

FIG. 1 is a cross-sectional view showing the schematic configuration of an ink-jet head 1 according to the present embodiment. FIG. 2 is a cross-sectional view showing an enlarged main portion of the ink-jet head 1. The ink-jet head 1 is formed by stacking a head substrate 10 and a wiring substrate 20 through an adhesive resin layer 30 and integrating them. On the upper surface of the wiring substrate 20, a box-shaped manifold 40 is provided; the interior of the manifold 40 forms a common ink chamber 41 where an ink is stored with the wiring substrate 20.

(About the Head Substrate)

The head substrate 10 includes, from the side of the bottom layer, a nozzle plate 11 formed with a Si (silicon) substrate, an intermediate plate 12 formed with a glass substrate, a pressure chamber plate 13 formed with Si of a support layer of a SOI (silicon on insulator) substrate, a diaphragm 14 formed with Si of an active layer of the SOI substrate and actuators 15. Nozzles 11*a* serving as discharge holes of the ink within pressure chambers 13*a*, which will be described later, are open to the bottom surface of the nozzle plate 11.

In the pressure chamber plate 13, a plurality of pressure chambers 13*a* holding the ink to be discharged are formed. The nozzles 11*a* and the actuators 15 described above are provided to correspond to the pressure chambers 13*a*. The upper wall of the pressure chamber plate 13 is formed with the diaphragm 14; its bottom wall is formed with the intermediate plate 12. In the intermediate plate 12, communication passages 12*a* that make the interior of the pressure chambers 13*a* communicate with the nozzles 11*a* are formed so as to penetrate the intermediate plate 12.

The actuator 15 is configured by sandwiching a piezoelectric member 15*a* formed as the main body of the actuator with a thin-film PZT ($Pb(Zr,Ti)O_3$) between an upper electrode 15*b* and a lower electrode 15*c*. In other words, the actuator 15 is formed by stacking the lower electrode 15*c*, the piezoelectric member 15*a* and the upper electrode 15*b* in this order.

The lower electrode 15*c* is formed on the surface of the diaphragm 14; on the lower electrode 15*c*, the piezoelectric member 15*a* and the upper electrode 15*b* on the upper surface thereof are stacked individually such that they correspond one by one to the pressure chamber 13*a*. On the upper electrode 15*b*, a gold stud bump 16 (second electrode) having a melting point of 1063° C. is formed to protrude toward the wiring substrate 20. The gold stud bump 16 is electrically connected to the upper electrode 15*b*.

(About the Wiring Substrate)

In the wiring substrate 20, on the upper surface of a substrate main body 21 formed with a Si substrate, an upper wiring 23 is formed through a wiring protective layer 22 made of $SiO_2$. The upper wiring 23 described above is, at the end portions of the wiring substrate 20, electrically connected with a FPC (flexible printed circuit board) 25 on which a drive IC 24 is mounted through an ACF (anisotropic-conductive film). The upper wiring 23 is covered with a wiring protective layer 26 made of $SiO_2$.

A part of the upper wiring 23 faces the bottom surface of the substrate main body 21 through a through hole 21*a* formed in the substrate main body 21, and is electrically continuous with a lower wiring 27 formed on the bottom surface of the substrate main body 21. Although under the lower wiring 27, a wiring protective layer 28 made of $SiO_2$ is formed, a part of the lower wiring 27 is exposed to the outside of the wiring protective layer 28 through an opening portion 28*a* formed in a position facing the actuator 15. At the lower wiring 27 exposed in the position of the opening portion 28*a*, a solder bump 29 (first electrode) is formed to protrude toward the head substrate 10. The solder bump 29 and the gold stud bump 16 are electrically connected to each other while they are exposed to the space between the head substrate 10 and the wiring substrate 20.

The solder bump 29 is formed with, for example, a Sn—Bi system eutectic solder (having a melting point of 139° C.), and bows outward in the shape of a hemisphere from the exposed surface of the lower wiring 27 toward the actuator 15; its end surface (lower end surface) is formed spherically.

The head substrate 10 and the wiring substrate 20 described above are individually manufactured, and are thereafter arranged opposite each other through the adhesive resin layer 30. Specifically, the surface of the head substrate 10 on the side of the actuator 15 and the surface of the wiring substrate 20 on the side of the wiring protective layer 28 are made to face each other and are adhered to each other through the adhesive resin layer 30, and thus the head substrate 10, the wiring substrate 20 and the adhesive resin layer 30 are integrally stacked.

(About the Adhesive Resin Layer)

The adhesive resin layer 30 is an adhesive layer with which the head substrate 10 and the wiring substrate 20 are adhered to each other. The adhesive resin layer 30 of the present embodiment is a thermosetting adhesive resin layer that has a predetermined elastic modulus (for example, 0.1 to 2.5 GPa) before the adhesion, that is cured by being heated to a predetermined curing temperature (for example, 200° C.) at the time of the adhesion and that achieves an adhesive function; the adhesive resin layer 30 is formed with, for example, a thermosetting and photosensitive adhesive resin sheet. As the adhesive resin layer 30 as described above, for example, a photosensitive polyimide adhesive sheet made by Toray Industries, Inc., PerMX series (product name) made by Du Pont Kabushiki Kaisha or the like can be used.

In order to acquire a space corresponding to the thickness of the adhesive resin layer 30 between the head substrate 10 and the wiring substrate 20, the adhesive resin layer 30 is previously adhered to the surface (bottom surface) of the wiring protective layer 28 of the wiring substrate 20, and is thereafter adhered to the head substrate 10. In the adhesive resin layer 30, after the adhesion to the wiring substrate 20 but before the stacking on the head substrate 10, a region corresponding to the actuator 15 and its vicinity is removed by exposure and development. Thus, when the head substrate 10 and the wiring substrate 20 are adhered to each other with the adhesive resin layer 30, between the head substrate 10 and the wiring substrate 20, a space 31 for simultaneously holding the actuator 15 (especially, the piezoelectric member 15*a* and the upper electrode 15*b*), the gold stud bump 16 and the solder bump 29 can be acquired. The details of the space 31 will be described later.

As described above, the photosensitive adhesive resin sheet is used as the adhesive resin layer 30, and thus an unnecessary part that is the space holding the actuator 15 can be easily removed by exposure and development processing, and it is easy to form the layer of a desired pattern; as long as sealing can be achieved while the necessary space is being provided between the wiring substrate 20 and the head substrate 10, the adhesion may be achieved in any method other than the above method using any material such as another resin, glass or metal.

Moreover, in the adhesive resin layer 30, a through hole 32 penetrating it up and down is previously formed by exposure, development and the like in the same manner as described above; its end (upper end) communicates with an ink supply path 21*b* formed in the wiring substrate 20; the other end (lower end) communicates with the interior of the pressure chamber 13*a* through an opening 14*a* formed in the diaphragm 14 of the head substrate 10. The ink supply path 21*b* is open to the upper surface of the wiring substrate 20; the ink within the common ink chamber 41 can be supplied into the pressure chamber 13*a* by passing the ink through its opening portion 26*a* thereinto.

(About the Operation)

Since the gold stud bump 16 on the side of the head substrate 10 and the solder bump 29 on the side of the wiring substrate 20 are electrically connected to each other, a drive voltage (drive signal) from the drive IC 24 of the wiring substrate 20 is supplied to the upper electrode 15*b* of the actuator 15 through the upper wiring 23, the lower wiring 27, the solder bump 29 and the gold stud bump 16 in this order. As described above, the drive voltage is supplied to the upper electrode 15*b* relative to the lower electrode 15*c* of the actuator 15, and thus the piezoelectric member 15*a* is deformed by the piezoelectric effect to vibrate the diaphragm 14. In this way, a pressure for discharge is applied to the ink within the pressure chamber 13*a*, and thus the ink is discharged, as minute droplets, from the nozzle 11*a* through the communication passage 12*a*.

It can be said from what has been described above that the actuator 15 receives, with the upper electrode 15*b* on the surface, the power fed from the wirings (the upper wiring 23 and the lower wiring 27) of the wiring substrate 20 and discharges the ink within the pressure chamber 13*a* through the nozzle 11*a*.

(About the Exposure Space of the Bump)

As described above, between the head substrate 10 and the wiring substrate 20, the space 31 for holding the piezoelectric member 15*a*, the upper electrode 15*b*, the gold stud bump 16 and the solder bump 29 is acquired. Moreover, the head substrate 10 and the wiring substrate 20 are adhered to each other through the adhesive resin layer 30, and thus the space 31 is hermetically sealed. In the present embodiment, the space 31 described above is filled with nitrogen (dried nitrogen gas) serving as an inert gas.

In order for nitrogen to be sealed in the space 31, the head substrate 10 and the wiring substrate 20 are adhered to each other with the adhesive resin layer 30 in an atmosphere of dried nitrogen. Specifically, in an atmosphere of dried nitrogen, with the adhesion surface of the adhesive resin layer 30 facing the side of the head substrate 10, the wiring substrate 20 to which the adhesive resin layer 30 is attached is stacked on the upper surface of the lower electrode 15*c* formed on the surface of the diaphragm 14 of the head substrate 10. Thereafter, the adhesive resin layer 30 is heated to a predetermined curing temperature, and the head substrate 10 and the wiring substrate 20 are crimped and adhered to each other through the adhesive resin layer 30.

As described above, the space 31 in which the gold stud bump 16 and the solder bump 29 are exposed to the outside of the wiring protective layer 28 and which is hermetically sealed is filled with nitrogen serving as an inert gas. In this case, since water (water vapor) is not present around the part where the gold stud bump 16 and the solder bump 29 are electrically connected, the above connection part is prevented from being degraded by reaction with the water. Thus, even when the actuator 15 is repeatedly driven, the occurrence of a contact failure in the connection part can be reduced, and the reliability of the electrical connection between the head substrate 10 and the wiring substrate 20 can be enhanced.

Since the solder that is the material of the solder bump 29 can be easily melted by heating and can be joined to the gold stud bump 16, it is possible to easily perform the electrical connection described above.

One way to prevent the degradation by reaction with the water is to form the solder bump 29 with a bump of the same material (Au) as the gold stud bump 16; however, in this case, since Au is used as the material of both bumps of the head substrate 10 and the wiring substrate 20, the cost of the bumps and hence the cost of the ink-jet head 1 are increased. Moreover, since the melting point of Au is so high as to be 1063° C., in the manufacturing process, it is very difficult to heat and melt, and then join both bumps. Hence, when both bumps are formed of Au, electrical connection is performed only by contact, instead of by joining, with the result that the attachment of dust through water in the atmosphere easily causes a connection failure.

In this respect, in the present embodiment, since a simple method of hermetically sealing the space 31 where the gold stud bump 16 and the solder bump 29 are exposed and of filling the space 31 with nitrogen is adopted to remove the water causing the degradation, it is possible to easily and reliably reduce the degradation of the connection part and to easily and reliably enhance the reliability of the electrical connection. Moreover, since only the gold stud bump 16 is formed of Au, and Au is not used as the material of the other bump, the present embodiment is advantageous in terms of cost.

Incidentally, the space 31 described above may be filled with dried air instead of an inert gas. The dried air refers to air in which the amount of water vapor (water vapor pressure) in the air is significantly reduced such that its humidity is 10% or less and is preferably 1% or less. As described above, the space 31 is filled with the dried air, and thus it is also possible to reduce the degradation by reaction with the water around the connection part between the gold stud bump 16 and the solder bump 29, with the result that it is possible to enhance the reliability of the electrical connection between the head substrate 10 and the wiring substrate 20.

The dried air described above can be obtained by, for example, the following methods (1) to (3).

(1) Damp air is so cooled as to be temporarily condensed and is thereafter heated as necessary, and thus dried air is obtained.

(2) Damp air is brought into contact with a hygroscopic agent such that water vapor is absorbed, and thus dried air is obtained.

(3) Damp air is passed through a hollow fiber membrane such that water vapor is separated, and thus dried air is obtained.

The space 31 described above may be filled with an inert gas other than nitrogen. For example, a rare gas such as argon, helium or krypton may be used as an inert gas to fill the space 31.

Since nitrogen and rare gases are chemically stable gases that do not react with other substances, the connection part between the gold stud bump 16 and the solder bump 29 is prevented from being degraded by reaction with the filling gas. Thus, it is possible to reliably enhance the reliability of the electrical connection between the head substrate 10 and the wiring substrate 20.

Furthermore, the space 31 described above may be in a vacuum state where it is not filled with any gas. In other words, as long as such an amount of water as to degrade or inhibit the connection of the bumps is not contained, the space 31 may be in any state.

Incidentally, in the present embodiment, not only the gold stud bump 16 and the solder bump 29 but also the piezoelectric member 15*a* and the upper electrode 15*b* of the actuator 15 are located within the space 31 which is hermetically sealed to remove water (see FIG. 2). In this way, the piezoelectric member 15*a* is prevented from being degraded by reaction with water in the atmosphere, the piezoelectric member 15*a* is prevented from being degraded by release of oxygen, which is a constitutional element of the piezoelectric member 15*a*, into the atmosphere and the upper electrode 15*b* is also prevented from being degraded by water. Thus, it is possible to prevent the decrease in the characteristic (piezoelectric characteristic) of the actuator 15.

Moreover, the configuration in which the space 31 where all the gold stud bump 16, the solder bump 29, the piezoelectric member 15*a* and the upper electrode 15*b* are present is hermetically sealed can be easily realized by adhering the head substrate 10 and the wiring substrate 20 through the adhesive resin layer 30; with such a simple configuration, it is possible to simultaneously obtain the effect of enhancing the reliability of the electrical connection described above and the effect of acquiring the desired piezoelectric characteristic.

In a configuration in which the nozzles 11*a* and the actuators 15 are arranged to respectively correspond to a plurality of pressure chambers 13*a* such that drawing is performed with higher definition, as in the present embodiment, the head substrate 10 and the wiring substrate 20 are arranged opposite each other, and the wiring structure on the side of the head substrate 10 is often simplified. Hence, the configuration of the present embodiment with which it is possible to enhance the reliability of the electrical connection between the head substrate 10 and the wiring substrate 20 is significantly effective for the ink-jet head 1 that performs such drawing with higher definition.

The melting point (1063° C.) of the gold stud bump 16 is higher than the curing temperature (200° C.) when the head substrate 10 and the wiring substrate 20 are joined with the adhesive resin layer 30; the melting point (139° C.) of the solder bump 29 is equal to or less than the curing temperature (200° C.) at the time of the joining. As described above, at least one of the two bumps is formed with a material having a melting point equal to or less than the curing temperature (heating temperature) of the adhesive resin layer 30, and thus the bumps are melted at the time of the joining, and the bumps are electrically joined to each other. In this way, it is possible to join the head substrate 10 and the wiring substrate 20 with the adhesive resin layer 30 and simultaneously connect them electrically.

The gold stud bump 16 is provided as a first bump on the wiring substrate 20, and the solder bump 29 is provided as a second bump on the head substrate 10, with the result that both bumps may be electrically connected or both bumps may be formed of solder. Furthermore, as long as electrical connection can be achieved, any material may be used for each of the bumps.

(About an Ink jet Drawing Device)

An ink-jet drawing device 50 including the ink-jet head 1 configured as discussed above will now be described.

Figure 3:
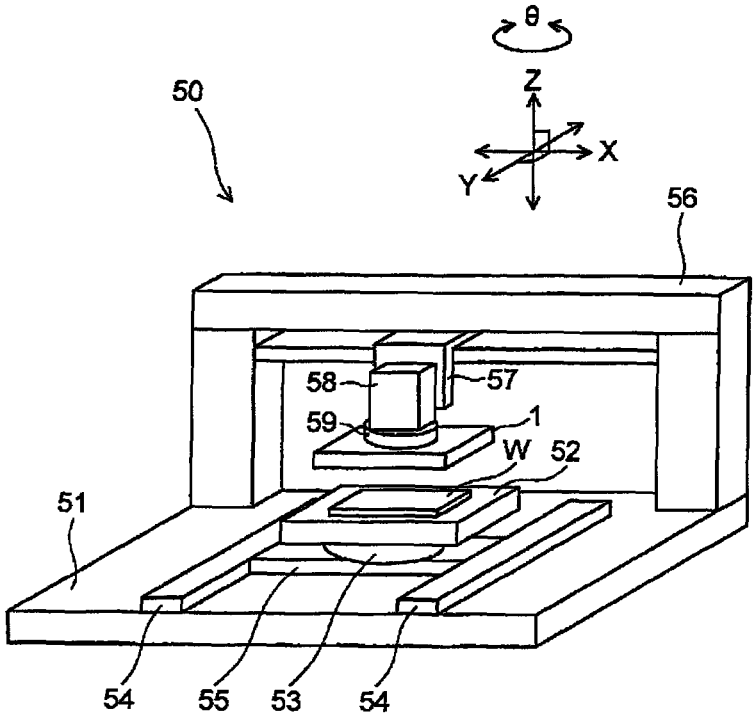
[FIG. 3] A perspective view showing the schematic configuration of an ink-jet drawing device including the ink-jet head.
Figure 4:
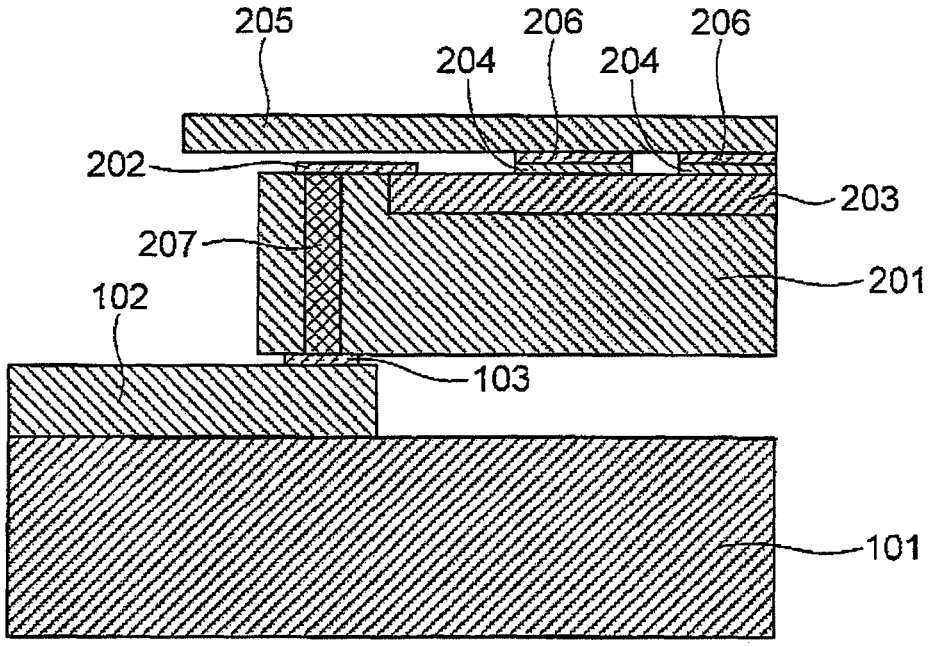
[FIG. 4] A cross-sectional view the schematic configuration of the main portion of a conventional ink-jet head.

FIG. 3 is a perspective view showing the schematic configuration of the ink-jet drawing device 50. The ink jet drawing device 50 includes the ink jet head 1 for performing inkjet drawing and a base stage 51. On the base stage 51, a stage 52, a θ rotation mechanism 53, a Y movement mechanism 54 and an X movement mechanism 55 are provided. The X direction and the Y direction are assumed to be perpendicular to each other on the horizontal plane; a rotation direction within an XY plane is assumed to be a θ direction. The direction perpendicular to the X direction and the Y direction is assumed to be a Z direction.

The stage 52 is a surface plate that is provided, through the θ rotation mechanism 53, on the X movement mechanism 55 extending in the X direction and that is formed in the shape of a rectangle as seen in plan view; its upper surface is a horizontal placement surface for placing a recording member W; the placement surface is provided so as to be in a predetermined height position with respect to the nozzle surface of the ink-jet head 1. The θ rotation mechanism 53 rotates and moves the stage 52 in the θ direction while being kept parallel to the nozzle surface of the ink-jet head 1. The Y movement mechanism 54 linearly moves together the stage 52, the θ rotation mechanism 53 and the X movement mechanism 55 in the Y direction. The X movement mechanism 55 linearly moves together the stage 52 and the θ rotation mechanism 53 in the X direction.

The ink-jet head 1 is attached to a gantry 56 provided over in the X direction, in the vicinity of an end portion on the base stage 51, through a slider 57, a Z movement mechanism 58 and a θ rotation mechanism 59, such that the nozzle surface is its bottom surface; the ink-jet head 1 is arranged opposite the surface of the recording member W on the stage 52 arranged below the ink jet head 1.

In the configuration described above, the ink jet head 1 is reciprocated in the X direction by the slide movement of the slider 57 along the gantry 56, is moved up and down in the Z direction by the Z movement mechanism 58, together with the θ rotation mechanism 59 and is further rotated and moved in the θ direction about the Z direction serving as an axis by the θ rotation mechanism 59.

On the other hand, the stage 52 on which the recording member W is placed is linearly moved in the X direction by the X movement mechanism 55 together with the θ rotation mechanism 53. The X movement mechanism 55 is linearly moved in the Y direction by the Y movement mechanism 54 together with the θ rotation mechanism 53. Furthermore, the stage 52 is rotated and moved in the θ direction about the Z direction serving as an axis by the θ rotation mechanism 53. Thus, the recording member W on the stage 52 is moved in the X direction and the Y direction, and is rotated and moved in the θ direction.

As described above, the ink-jet head 1 and the stage 52 are relatively moved, the discharge of droplets (ink) from the ink jet head 1 is controlled according to positional information on the relative movement, based on predetermined discharge pattern data and the droplets are made to reach the surface of the recording member W on the stage 52, with the result that it is possible to perform desired drawing on the recording member W.

Since the ink-jet head 1 described above can enhance the reliability of the electrical connection between the head substrate 10 and the wiring substrate 20, drawing is performed on the recording member W on the stage 52 by the ink discharged from the ink-jet head 1, and thus it is possible to realize the reliable ink-jet drawing device 50.

INDUSTRIAL APPLICABILITY

The ink jet head of the present invention can be utilized for an ink jet drawing device.

LIST OF REFERENCE SYMBOLS

1 ink-jet head
10 head substrate
11*a* nozzle
13*a* pressure chamber
15 actuator
15*a* piezoelectric member
15*b* upper electrode
15*c* lower electrode
16 gold stud bump (second electrode)
20 wiring substrate
23 upper wiring (wiring)
27 lower wiring (wiring)
29 solder bump (first electrode)
30 adhesive resin layer (adhesive layer)
31 space
50 ink-jet drawing device
W recording member

The invention claimed is:

1. An ink-jet head comprising:
a wiring substrate having a wiring; and
a head substrate including
a pressure chamber that holds an ink,
a nozzle that serves as a discharge hole of the ink within the pressure chamber, and
an actuator that receives, with an electrode on a surface, power fed from the wiring of the wiring substrate and that discharges the ink within the pressure chamber through the nozzle,
wherein the wiring substrate includes a first electrode that is electrically connected to the wiring and that protrudes to a side of the head substrate,
wherein the actuator includes a second electrode that is electrically connected to the electrode, that protrudes to a side of the wiring substrate and that is electrically connected to the first electrode,
wherein the head substrate and the wiring substrate are adhered to each other through an adhesive layer such that a space to which the first electrode and the second electrode are exposed is hermetically sealed,
wherein the hermetically sealed space is in a vacuum state or is filled with a gas containing a predetermined amount of water or less,
wherein the adhesive layer is formed with a thermosetting adhesive resin layer, and
wherein a melting point of one of the first electrode and the second electrode is equal to or less than a curing temperature when the head substrate and the wiring substrate are joined together with the thermosetting adhesive resin layer.

2. The ink-jet head of claim 1,
wherein the gas containing the predetermined amount of water or less is an inert gas, and
the inert gas is nitrogen or a rare gas.

3. The ink-jet head of claim 1,
wherein the gas containing the predetermined amount of water or less is dried air.

4. The ink-jet head of claim 1,
wherein the actuator is formed by stacking a lower electrode, a piezoelectric member and an upper electrode in this order,
the electrode receiving the power fed from the wiring of the wiring substrate is formed with the upper electrode, and
the piezoelectric member and the upper electrode are located, together with the first electrode and the second electrode, within the hermetically sealed space.

5. The ink-jet head of claim 1,
wherein the head substrate includes a plurality of the pressure chambers, and
the nozzles and the actuators are provided so as to correspond to the plurality of the pressure chambers.

6. The ink-jet head of claim 1,
wherein a melting point of the other electrode other than the one of the first electrode and the second electrode is higher than the curing temperature.

7. An ink-jet drawing device comprising:
the ink-jet head of claim 1; and
a stage on which a recording member is to be placed,
wherein drawing is performed on the recording member on the stage with the ink discharged from the ink-jet head.

* * * * *